United States Patent [19]

Ross et al.

[11] Patent Number: 4,868,759

[45] Date of Patent: Sep. 19, 1989

[54] MASTER POSITION ENCODER FOLLOWER SYSTEM FOR FILM FEEDING MEANS

[75] Inventors: Jeffrey L. Ross, Pulaski; Richard S. Jenkins, Oconto, both of Wis.

[73] Assignee: FMC Corporation, Chicago, Ill.

[21] Appl. No.: 931,277

[22] Filed: Nov. 14, 1986

[51] Int. Cl.[4] ..... B65B 57/00; B65B 59/02; B65B 51/26

[52] U.S. Cl. ..... 364/468; 364/132; 364/167.01; 53/51

[58] Field of Search ..... 364/468, 469, 471, 132, 364/167, 474, 475; 318/625, 38, 601; 53/55, 51; 493/1, 2, 11, 34; 226/2, 4, 29, 30

[56] References Cited

U.S. PATENT DOCUMENTS

| | | | |
|---|---|---|---|
| 4,174,237 | 11/1979 | Hemming, Jr. et al. | 364/471 |
| 4,316,566 | 2/1982 | Arleth et al. | 53/51 |
| 4,414,495 | 11/1983 | Sumi et al. | 318/625 |
| 4,514,819 | 4/1985 | Punater et al. | 364/471 |
| 4,525,977 | 7/1985 | Matt | 53/55 |
| 4,549,386 | 10/1985 | Wilson | 53/51 |
| 4,553,368 | 11/1985 | Ziller | 53/51 |
| 4,565,950 | 1/1986 | Kikuno | 318/625 |
| 4,656,577 | 4/1987 | Herman | 318/625 |

*Primary Examiner*—Allen MacDonald

*Attorney, Agent, or Firm*—Douglas W. Rudy; Richard B. Megley

[57] ABSTRACT

Package wrapping machine infeed conveyor and film web control utilize an infeed conveyor position signal compared to film web signal to adjust the film web letoff to the article in feed conveyor to deliver the article and the film web to a film forming location in register. A processor outputs a digital signal to a motor speed controller which will increase or decrease the feed web letoff rate. Input from the infeed conveyor may be processed by the processor to perform forward or reverse correction as necessary to synchronize the infeed conveyor with the film web letoff.

7 Claims, 3 Drawing Sheets

MASTER POSITION ENCODER FOLLOWER SYSTEM FOR FILM FEEDING MEANS

A horizontal article wrapping machine has as its primary function the wrapping of articles at a film forming station. Typical films used in wrapping articles may have a printed film that must be in register with the article being wrapped to present a visually appealing marketable product. Numerous mechanical devices, generally termed "horizontal wrappers" are available. These horizontal wrappers often use mechanical timing arrangements to index or register the film to the article so that the article and the film meet at the film forming station in synchronization.

The mechanical apparatus of a typical horizontal wrapper incorporates an infeed conveyor which may be a motor driven belt receiving articles from a "feeder" which may singulate the articles being fed to the infeed conveyor. The infeed conveyor may be sequenced to present a single flight or zone for each article being transported thereon.

Articles will pass from the infeed conveyor to the film forming location where they will be wrapped.

Wrapping film will be supported at a film letoff stand and unwound, if the film is in roll form, by a film feed roll. Film feed rolls are one method of unwinding the film. Other well known methods of feeding the film to the film feed station include vertical or horizontal shaft finseal wheels, tubing belts, as well as combinations of feed rolls, finseal wheels and tubing belts. The film will, of course, be served to the film forming location.

After the film and the article to be wrapped have passed through the film forming location, the article will be surrounded by the film and the film tube will be transversly sealed thus packaging the article in the film. Cutoff apparatus and heat sealing apparatus are generally employed to seal and cutoff the package.

Some films used to wrap articles are unprinted films that simply cover the article. Such articles then may be placed in cartons or bags bearing identification of the article.

Other articles are wrapped in preprinted films that are generally printed with the trade dress and identification of the article. Such preprinted films must be capable of being positioned on the article so that the film is in register with the article.

An electronically controlled relationship between the infeed conveyor and a film feed apparatus is provided by the instant invention. In its simplest form a processing unit receives a digital input from the infeed apparatus or its drive and delivers a digital output to a second drive for the film feed apparatus. In a more complex embodiment the above input and output is further enhanced by the inclusion of a data entry device and multiple detectors to sense article and film web positions and compare that data with a desired set of data entered into the processor through the data entry device.

Some of the various possible embodiments contemplated by the inventors are shown in the drawing figures wherein.

Figure 1:
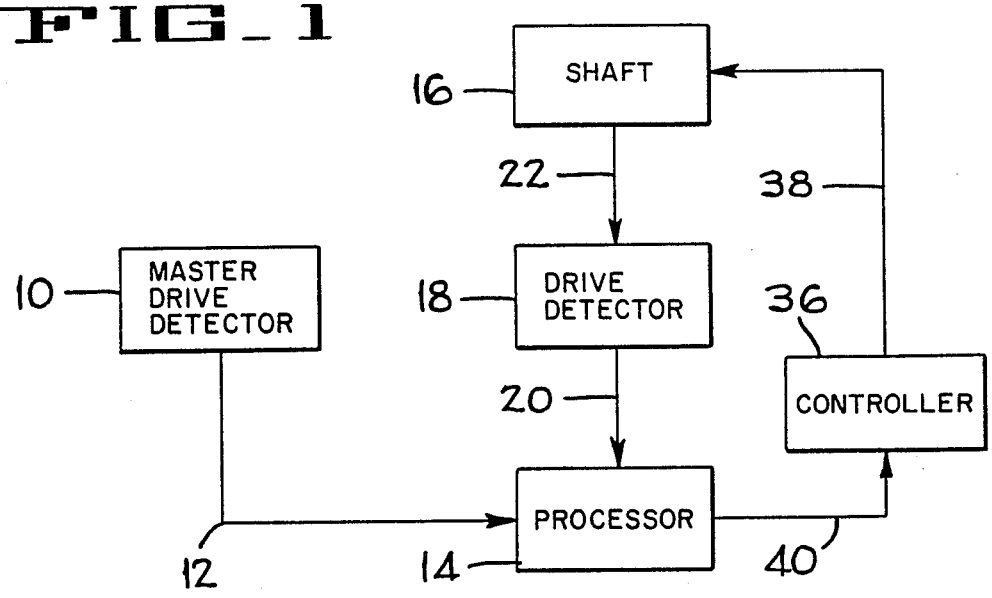
FIG. 1 is a block diagram of a simple electronically controlled article/film register unit.

FIG. 1 presents a first embodiment of the invention with conventional components shown as representative blocks labeled with the element being represented.

The master drive detector 10 would, in a preferred embodiment, be an encoder for sensing the position of a drive or driven shaft in a conventional manner. The master drive detector generates a first electrical pulse signal that is delivered via conduit 12 to a processor 14. The processor 14 is a digital processor of a general type capable of high speed comparison calculations determined by resident programs.

A shaft 16 is a conventional output shaft of a motor, or could alternatively be a shaft of an associated gear train, and is representative of the controlled element being controlled by the system represented by FIG. 1. Drive detector 18 is in direct communication with shaft 16 and is capable of sensing the position of the shaft. The drive detector 18 may, in a simplified control system be an encoder similar to the master drive detector 10. Drive detector 18 communicates via 20 with the processor 14. The motor whose shaft is labeled 16 is coupled to a power controller 36 through conduit 38. The power controller 36 receives commands through conduit 40 from the processor 14.

In the context of a horizontal wrapping machine the FIG. 1 control will operate as follows. An infeed conveyor will be driven by a motor. The motor shaft would be connected either mechanically or non-mechanically, such as by a proximity switch, magnetic field detector, a photo electric connection or similar apparatus to a shaft position sensing device, the master drive detector 10, which in a preferred embodiment would be a shaft encoder. This encoder would be the "master" coupled to the infeed conveyor thus the distance traveled by the infeed conveyor would be the benchmark to which the rest of the horizontal wrapper would be tuned. Articles to be wrapped are transported on the infeed conveyor in a singulated manner such that one article or one group of multiple units, which hereinafter will be considered a single article, will be presented to a film forming station at a time.

The film forming station will apply film being fed to the station to the article. This entails wrapping the article with film, sealing the film around the outside of the article and cutting the film to cause it to fit the article.

Film will be fed to the film forming station at a rate sufficient to provide wrapping film for the number of articles being wrapped at the film forming station. Film would typically be stored in roll form and let off or unrolled as needed by film feed rolls and served to the film forming station. Film feed rolls are located between the film storage area and the film forming station.

The film feed rolls, not shown, are connected to a drive shaft such as 16 which is connected to the drive detector 18.

In one embodiment the drive detector 18 is eliminated and the drive shaft becomes part of a stepper motor assembly. The stepper motor will allow shaft rotation to progress at a rate signalled to the stepper motor from the processor. Stepper motors have the unique capability of rotating a predetermined distance whenever a single step pulse is delivered to it.

An alternative embodiment is the use of a conventional electric motor in place of the stepper motor. In such case the conventional motor drive shaft will be magnetically, optically or mechanically coupled to a drive detector, which in this embodiment, would be an encoder.

The processor would work in a similar manner under either alternative embodiment.

The first electrical pulse signal received by the processor 14 via conduit 12 would be the master signal that the wrapping machine will follow in all its actions including the linear quantity of film let off the film supply as served by the film feed rolls. The master drive detector 10 coupled to the main drive motor will generate a pulse signal proportional to the actual distance advanced by the infeed conveyor.

In the simplest embodiment a digital signal from the encoder or master drive detector 10 will be sent to power circuit of the stepper motor and have the stepper motor increment to match the master drive detector 10 digital output. In actual operation, depending on equipment selection, it may be necessary to interpose a stepper motor amplifier having input means to receive the output signal from the processor 14 and thereafter output signals to the stepper motor. In this manner the stepper motor driving the film feed will feed an amount of film corresponding to the number of articles being fed to the film forming station by the infeed conveyor.

In this embodiment the necessity for a digital processor is not present if the master drive detector 10 or encoder is matched with the stepper motor in operating parameters and triggers the necessary power circuit of the stepper motor or a stepper motor amplifier.

In an alternative embodiment the processor 14 will be interposed between the master drive detector 10 and the controller 36, which as previously stated, could be a stepper motor or could be a conventional drive motor.

The processor in the stepper motor embodiment will be utilized to monitor the first electrical pulse signal coming into the processor 14 via 12 from the master drive detector 10. The processor will be preset to select a count multiply or divide factor for processing the first electrical pulse signal. The count multiply or divide factor will be referred to as F1. The count multiply/divide factor F1 will be selected by the processor such that when the two drives are moving; that is, the drive being served by the master drive detector 10, typically the infeed drive motor; and the stepper motor drive for shaft 16, are moving at the desired preset ratio, the second drive will be synchronized with the first drive. Thus as the infeed conveyor moves a distance corresponding to the distance necessary to feed a single article the film feed drive will let off an amount of film necessary to wrap that one article.

The processor combines the first electrical pulse signal times its factor F1 and will output this combined value as a signal to the stepper motor 18 directly or to a stepper motor amplifier as necessary.

The processor in a conventional drive motor embodiment will be utilized to compare the ratio of the first electrical pulse signal coming into the processor 14 via 12 from the master drive detector 10 with the second electrical pulse signal coming into the processor 14 via line 20 from the drive detector 18. Typically the processor will be preset to select count multiply factors for processing the first and second electrical pulse signals. The count multiply factor for the first electrical pulse signal will be referred to as $F_1$, while the count multiply factor for the second electrical pulse signal will be referred to as $F_2$. The count multiply factors will be selected by the processor such that when the two drives are moving; that is, the drive being served by the master drive detector 10, typically the infeed drive motor; and the drive being served by the drive detector 18 (shaft 16 for instance), are moving at the desired preset ratio, the second drive will be synchronized with the first drive. Thus as the infeed conveyor moves a distance corresponding to the distance necessary to feed a single article the film feed drive will let off an amount of film necessary to wrap that one article.

The processor 14 would implement an up/down counter, preferably on-board, to combine the first electrical pulse signal times its factor $F_1$ (the up count) with the second electrical pulse signal times its factor $F_2$ (the down count) to generate a position error value $E_p$. The processor calculates the rate (R1) at which the first electrical pulse signal times F1 is occurring. The processor calculates the rate (R2) at which the second electrical pulse signal times F2 is occurring. The processor then calculates using R1 and Ep an idealized rate value ($R_p$) for the second motor that will correct the position error to within a preset limit. The second rate ($R_2$) and the ideal rate (RI) are compared to obtain a rate error ($E_R$). The error rate is multiplied by a preset value and this new value is added to the idealized rate value to obtain the command rate for the second motor as represented by the shaft 16.

The processor will output its rate command to a motor amplifier to change the rate and position of the second motor in response to the infeed conveyor rate and distance traveled.

Figure 2:
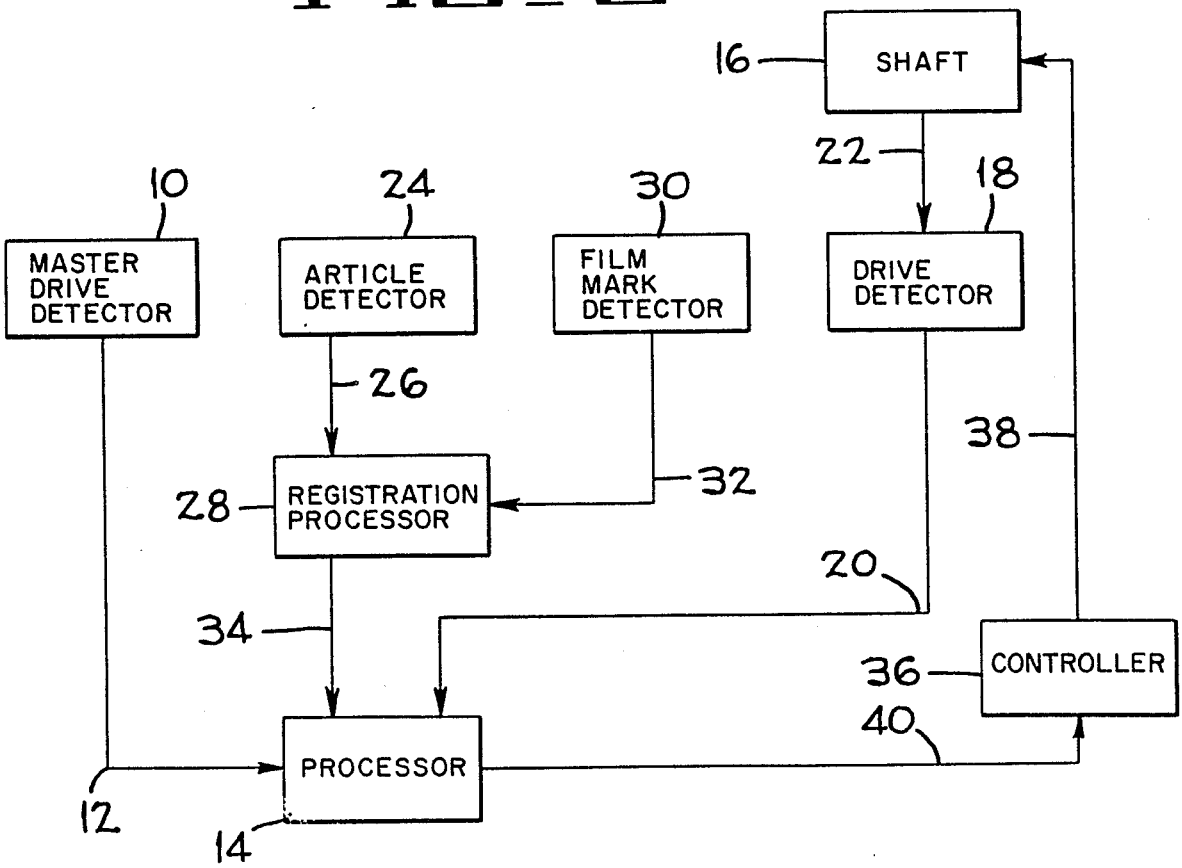
FIG. 2 is a block dragram of a modified version of FIG. 1.

FIG. 2 presents an enhanced embodiment of what was presented in FIG. 1. Shown are the master drive detector 10, the processor 14, the drive detector 18 and the shaft 16 all as presented in FIG. 1. The processor 14 may be relied on more heavily in this embodiment as it will have more inputs to process.

Two additional detectors are presented in FIG. 2.

An article detector 24 is connected by conduit 26 to a registration processor 28. The article detector 24 can be and in a preferred embodiment would be, a timing switch that is connected to the infeed conveyor associated with the master drive detector 10. The timing switch, or the article detector 2 would generate a pulse signal indicative of the preset forward and reverse correction zones.

A film mark detector 30 is provided to sense the passage of register marks on wrapping film being letoff, or rather, pulled off, the film storage apparatus by the film feed rolls. The film mark detector will produce a third electrical pulse signal indicative of the passage of register marks on said film. Such pulse signal is carried via conduit 32 to the registration processor 28.

The registration processor, whose function is to generate an error signal through conduit 34 to the processor which is indicative of whether a forward or reverse correction of the film feed is required, will compare the input from the article detector 24 to the film mark detector signal 32. The processor 14 will modify the first and/or second electrical pulse signals (increasing or decreasing number of pulses) prior to multiplying these signals by F1 and F2 respectively.

The processor 14 will receive a master digital position signal from the master drive detector 10. It will also receive an error signal from the registration processor 28 and a position signal from the drive detector 18 (on conventional motor systems).

The processor in the stepper motor embodiment will calculate the desired output ratio as before. The registration error signal 34 is used to increase or decrease the number of first electrical pulse signal pulses, depending on whether a forward or reverse correction is required. This modified first electrical pulse signal is then multiplied by F1 to obtain a desired ouput command.

The processor 14 in the conventional motor embodiment will calculate the changes, as before, of the first electrical pulse signal times the first electrical pulse signal multiply factor relative to the second electrical pulse signal times the second electrical pulse signal multiply factor. A position error value is calculated as earlier stated. The idealized rate value is calculated for correcting the position error of the shaft 16, realistically the second motor used for driving the film feed rolls. Rate 2 (the rate at which the second electrical pulse signal pulses are occurring) is subtracted from the idealized rate (Rate I) to obtain a rate error value.

The rate error is multiplied in the processor by a preset value which is added to the idealized rate value to obtain the command rate for the shaft 16 or the second motor. The command rate is outputted from the processor to a controller 36 which may be a motor amplifier to change the rate and position of the shaft 16 or second motor in response to the motion of the infeed conveyor and the position of the register marks on the film so that the article being wrapped is correctly located between register marks preprinted on the film. The controller may be a motor amplifier means that is capable of changing the rate and position of the film feeding rolls in response to the motion of the infeed conveyor or master drive detector 10 and the position of the register marks.

Figure 3:
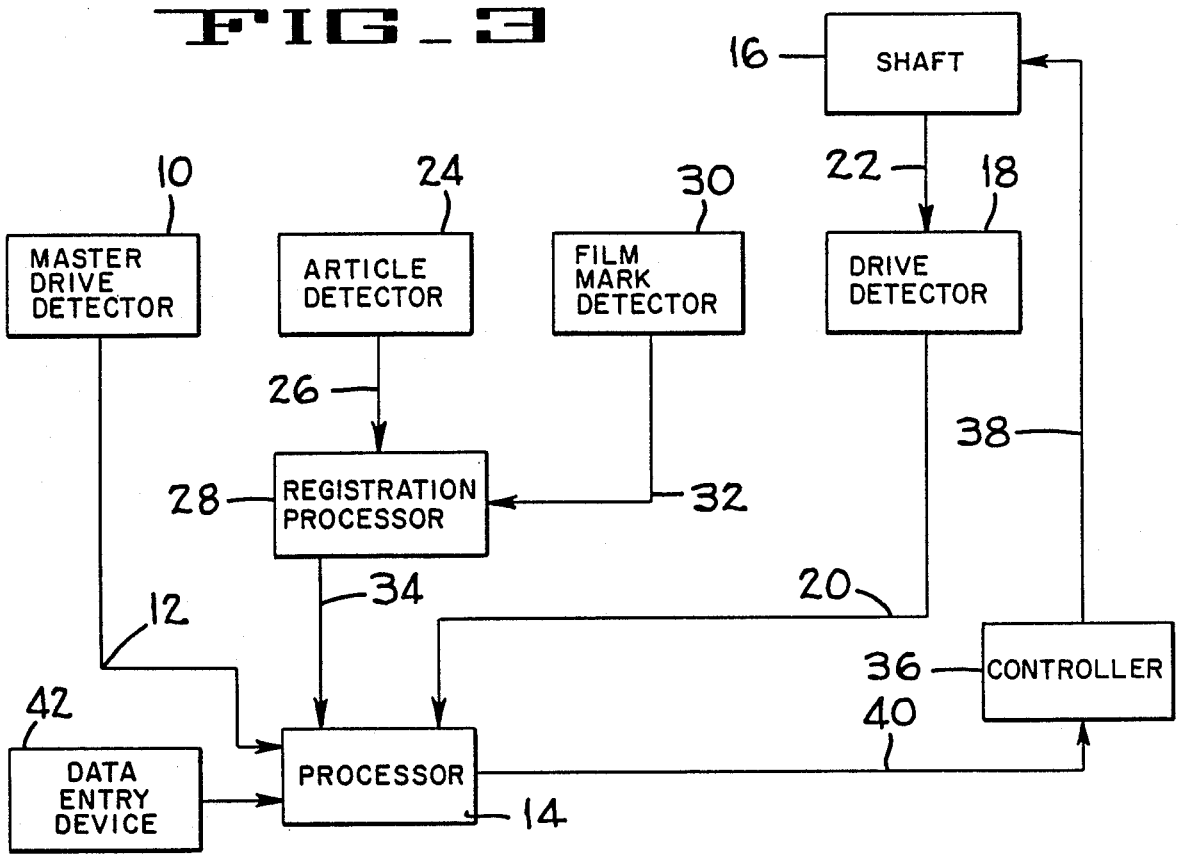
FIG. 3 is a block diagram of a modified version of FIG. 2.
Figure 4:
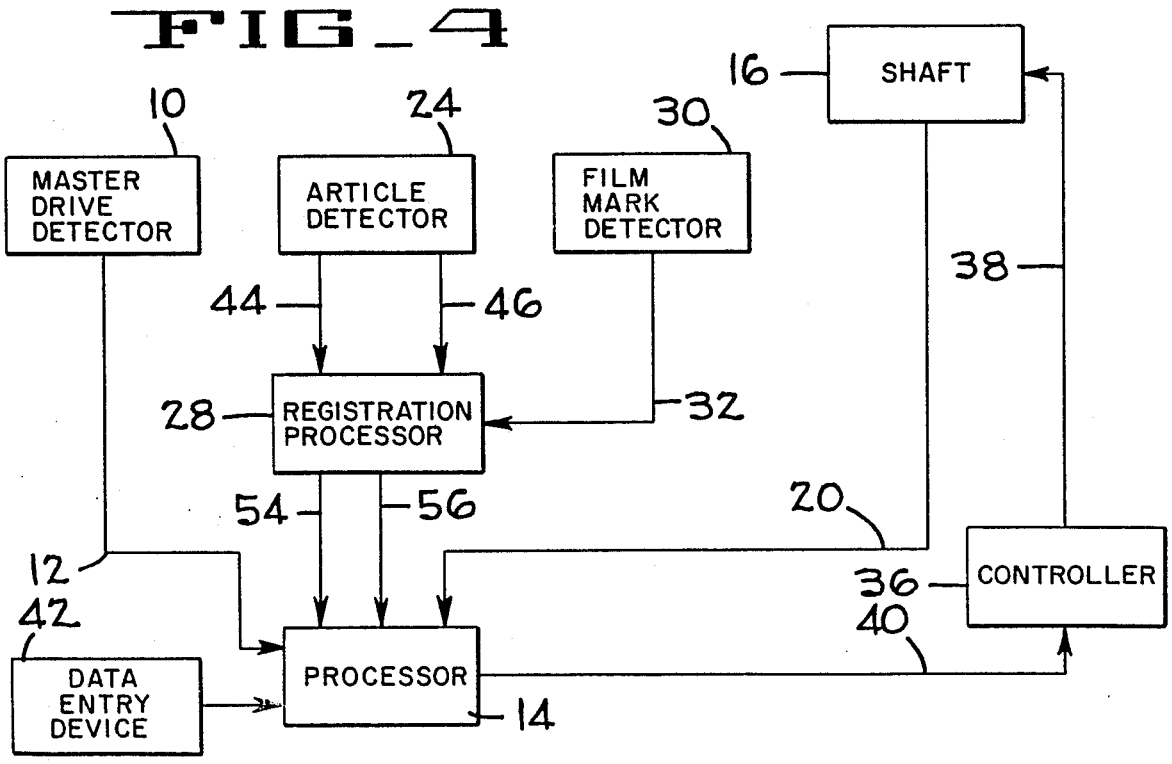
FIG. 4 is a block diagram of a modified version of FIG. 3.

FIG. 4 presents a system similar to that presented in FIG. 3 with the inclusion in FIG. 4 of conduit 46 to the article detector 24 and the inclusion of conduit 56 from the registration processor the the processor 14.

Figure 5:
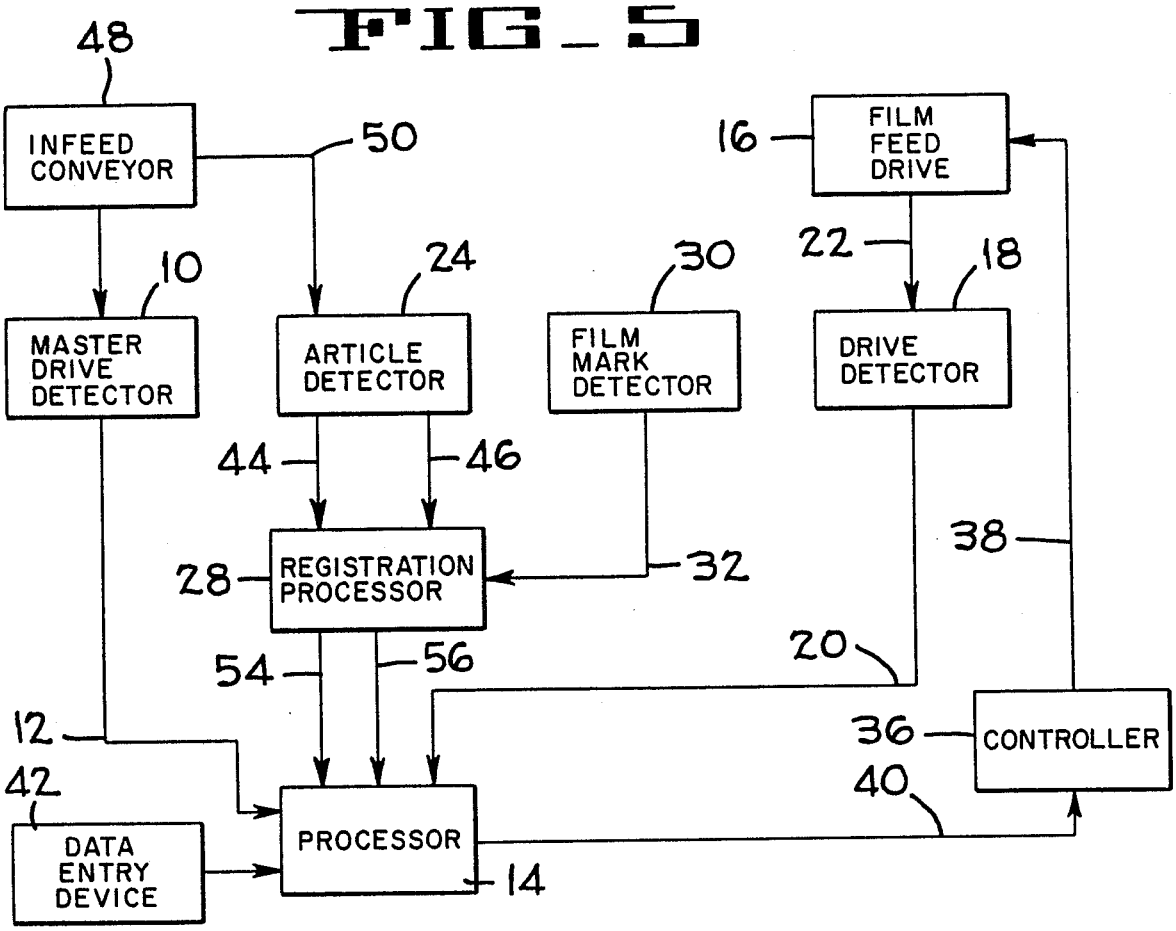
FIG. 5 is a block diagram of a modified version of FIG. 4.

The registration processor 28 receives fourth and fifth electrical pulse signals from the article detector and outputs a sixth electrical pulse signal, indicating the need for a forward correction, via conduit 54 to the processor 14, when both the third and fourth electrical pulses are both on (conduits 54 and 56). When the third and fifth electrical pulse signals are both on a reverse correction should be performed and a pulse is sent to the processor via conduit 56. FIG. 5 shows what may be the most preferred embodiment of the system as presented in this disclosure. This embodiment is similar to the earlier embodiments but will be completely explained.

The master drive detector 10 is, as in the previous embodiments, the main position encoder means and is coupled to the main drive motor means, or first electrical motor means, in this case the infeed conveyor 48. The master drive detector 10 produces a first electrical pulse signal proportional to the actual distance the infeed conveyor 48 advances. The first electrical pulse signal is conveyed via conduit 12 to the processor 14.

A second electrical motor means is the drive incorporated in the block labeled "film feed driver" 16 which could be the aforesaid film feed rolls, finseal wheels, tubing belts or other film feed means. An encoder, such as the drive detector 18, typically a position encoder, is coupled to the shaft 16 magnetically, optically or mechanically via 22 and produces a second electrical pulse signal proportional to the actual linear distance the film being fed is advanced.

A first detector means 30 is provided for sensing the passage of register marks on the wrapping film at an operator adjustable reference point and producing a third electrical pulse signal via 32 to the processor 28.

A fourth electrical pulse signal generating means 44 is connected to the infeed conveyor means to generate a signal indicative of a preset forward correction zone. This again could be a timing switch 24 geared to the infeed conveyor via 50 that senses an article on the infeed conveyor 10.

A fifth electrical pulse signal generating means 46 is also connected to the infeed conveyor means 48 to generate a signal indicative of a preset reverse correction zone. This again could be a timing switch 24 geared to the infeed conveyor via 50.

The registration processor 28, generically a logic means, is electrically coupled to the film web detector 30 to receive the third electrical pulse signal therefrom. It is also connected via conduits 44 and 46 to the article detector to receive the fourth and fifth electrical pulse signals.

When both the third and fourth electrical pulse signals are both on, a sixth electrical pulse signal, indicating that a forward correction is necessary, will be generated by the registration processor 28 and delivered via conduit 54 to the processor 14. Obversly when the third and fifth electrical pulse signals are both on, a reverse correction should be performed and a pulse is sent to the processor 14 via conduit 56.

The processor 14, another logic means that may incorporate the first logic means if desired, will use the sixth and seventh electrical pulse signals to gate off or subtract pulses from the second electrical pulse signal 20 and the first electrical pulse signal 12 respectively, prior to their entry into the ratio multiply portion of the processor's program. Deducting pulses from the second and first electrical pulse signals generates intentional position errors so that the computer will recognize and correct them, thereby correcting also the film registration error.

The data entry device 42 permits the wrapper operator to enter a desired repeat length of the film as needed for each article. The processor will process the data from the data entry device for film repeat length and multiply it with a preset scale factor. The scale factor is used to convert the repeat length entered into a pulse ratio preset for use in ratioing the position and speed of the second motor 16, the film feed drive with the main drive encoder 10 which is driven with the infeed conveyor.

The processor will now use the pulse ratio preset to select count multiply factors for handling the first (12) and second (20) electrical pulse signals as they are first modified by the processor. The processor selects count multiply factors such that when the infeed conveyor drive and film feed drives are moving at the desired ratio, the first electrical pulse signal times its multiply factor $F_1$ is equal to the second electrical pulse signal times its multiply factor $F_2$.

The processor 14 implements an up/down counter to combine the first electrical pulse signal times its factor $F_1$ (the up count) with the second electrical pulse signal times its factor $F_2$ (the down count) to generate a position error value Ep.

The processor will calculate the rates at which the first electrical pulse signal times $F_1$ (Rate 1) and the second electrical pulse signal times $F_2$ (Rate 2) are changing. The position error $E_p$ is used in conjunction with Rate 1 by the processor to generate an idealized rate value (Rate $_I$) for the second motor driving the film feed drive 16 that will correct the position error to within a preset limit. Rate 2 and Rate $_I$ are compared to obtain a rate error ($E_R$).

The rate error (ER) is multiplied by a preset value (K) whose product is summed to the idealized rate value to obtain the command rate for the film feed drive 16.

The rate command value is outputed as a signal to the motor amplifier or controller 36 to change the rate and position of the motor for the film feed means in response to the motion of the infeed conveyor and the position of the register marks relative to the forward and reverse correction zones of the infeed conveyor.

By implementing the structure and relational associations of the components a preferred embodiment of a horizontal wrapper register control systems is provided that fulfills the objective of providing an efficient register control system for a horizontal wrapping machine. The appended claims attempt to succinctly claim the invention and by their scope are intended to encompass various nuances of design as would normally fall within the scope of these claims.

What is claimed is:

1. In an article wrapping apparatus having articles fed to a film forming location and a film web fed to said film forming location, the improvement comprising;

a first shaft digital motion detector for generating a first pulse signal;

a second shaft having a second shaft digital motion detector for generating a second pulse signal;

a processor adapted for receiving said first and said second pulse signals and capable of processing said pulses to determine a command signal, an up/down counter implemented by said processor to obtain said command signal by:

(a) multiplying an up count value F1 by said first pulse signal, yielding a first signal value R1 and also multiplying a down count value F2 by said second pulse signal yielding a second signal rate value R2;

(b) combining said R1 and R2 values to generate an error value Ep;

(c) generating an idealized rate value $R_I$ for said second shaft using said R1 and Ep values to correct the position error of said second shaft;

(d) comparing said R2 and $R_I$ values to obtain a rate error value ER; and (e) multiplying a preset value by said $E_R$ value with the multiplied product added to said $R_1$ value to obtain said command signal;

controller means receiving said command signal and for outputting a command to said second shaft.

2. The invention in accordance with claim 1 wherein said second shaft digital motion detector is a drive detector coupled to said second shaft and said drive detector outputting said second signal to said processor.

3. The invention in accordance with claim 1 wherein a film mark detector is provided to generate a third pulse signal to said processor, said third pulse signal summed with said first pulse signal to determine said command signal.

4. The invention in accordance with claim 1 wherein a film mark detector is provided to generate a third pulse signal summed with said second pulse signal to determine said command signal.

5. The invention in accordance with claim 3 wherein an article detector is provided to generate an article signal; and registration processor means for receiving and processing said article signal from said article detector and said third pulse signal from said film mark detector, said registration processor means comparing said article signal to said third pulse signal and generating an error signal to said processor means indicative of the need for a forward or reverse correction of said second shaft, said error signal of said registration processor means inputted to said processor means.

6. In an article wrapping apparatus having articles fed by an infeed conveyor to a film forming location and a film web fed to said film forming location, the improvement comprising:

a first shaft digital motion detector for generating a first pulse signal;

a second shaft having a second shaft digital motion detector for generating a second pulse signal;

a processor receiving said first and said second pulse signals and capable of processing said pulses to determine a pulse error;

a film mark detector for sensing a mark on said film web and generating a third pulse signal to said processor; and detector means responsive to said infeed conveyor and coupled thereto for generating at least one of a fourth pulse signal indicative of a forward correction zone and a fifth pulse signal indicative of a reverse correction zone, said processor comparing said third pulse signal to said fourth pulse signal and also to said fifth pulse signal and generating a sixth pulse signal indicating a reverse correction for said first pulse signal or generating a seventh pulse signal indicating a forward correction for said second pulse signal and said processor further comparing said first and second pulse signals and generating a position error signal and a rate error signal, said processor outputting a command signal for changing the rate and position of said second shaft and also subtracting pulses from said first and second pulse signals indicative of the need for the reverse and forward correction, respectively, of the position of the film web relative to said infeed conveyor.

7. The invention in accordance with claim 6 further including a data entry device for inputting data into said processor.

* * * * *